US006142860A

United States Patent [19]

Hashimoto

[11] Patent Number: 6,142,860

[45] **Date of Patent: *Nov. 7, 2000**

[54] GRINDING TOOL

[75] Inventor: Hiroshi Hashimoto, 1117-12, Hinata, Isehara-shi, Kangawa, 259-11, Japan

[73] Assignees: Hiroshi Hashimoto, Isehara; Tokyo Diamond Tools Mfg. Co. Ltd., Tokyo, both of Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/773,862

[22] Filed: Dec. 27, 1996

Related U.S. Application Data

[63] Continuation of application No. 08/427,037, Aug. 16, 1994.

[30] Foreign Application Priority Data

Aug. 18, 1993 [JP] Japan ..... 5-203963

[51] Int. Cl.[7] ..... B23F 21/03

[52] U.S. Cl. ..... 451/548; 451/541

[58] Field of Search ..... 451/541, 542, 451/548

[56] References Cited

U.S. PATENT DOCUMENTS

| | | | |
|---|---|---|---|
| 3,502,453 | 3/1970 | Baratto . | |
| 4,275,528 | 6/1981 | Higginbotham | 451/547 |
| 4,663,890 | 5/1987 | Brandt | 451/548 |
| 4,668,248 | 5/1987 | Dettelbach et al. . | |
| 4,757,645 | 7/1988 | Ozer et al. | 451/548 |
| 4,918,872 | 4/1990 | Sato et al. | 451/548 |
| 5,018,276 | 5/1991 | Asada | 451/541 |
| 5,020,283 | 6/1991 | Tuttle | 451/550 |
| 5,131,190 | 7/1992 | Gougouyan | 451/548 |
| 5,363,601 | 11/1994 | Baltazar et al. | 451/548 |

FOREIGN PATENT DOCUMENTS

| | | | |
|---|---|---|---|
| 0004454 | 10/1979 | European Pat. Off. . | |
| 0505615 | 9/1992 | European Pat. Off. . | |
| 0558869 | 9/1993 | European Pat. Off. . | |
| 0597723 | 5/1994 | European Pat. Off. . | |
| 352498 | 3/1960 | Japan . | |
| 1041430 | 9/1966 | United Kingdom . | |
| 1501570 | 2/1978 | United Kingdom . | |
| 2117289A | 3/1982 | United Kingdom | 451/548 |
| 2117289 | 10/1983 | United Kingdom . | |
| 2136019 | 9/1984 | United Kingdom . | |
| 2263911 | 11/1993 | United Kingdom . | |
| 8402300 | 6/1984 | WIPO . | |

OTHER PUBLICATIONS

Hashimoto et al., "Shear–mode Grinding of Brittle Materials and Surfaces Characteristics", *Int. J. Japan Soc. Prec. Eng.*, pp. 95–99, vol. 27, No. 2 (Jun. 1993).

*Primary Examiner*—David A. Scherbel
*Assistant Examiner*—Benjamin M. Halpern
*Attorney, Agent, or Firm*—Greer, Burns & Crain, Ltd.

[57] ABSTRACT

A grinding tool of the present invention is configured by having grinding surface that comes into direct contact with the surface of the object to be ground. Multiple small protuberances which include diamonds and other abrasive materials are formed on the grinding surface. Surface area of the small protuberances and the distance between the small protuberances are set such that the grinding resistance was maintained at an approximate constant value after a substantially constant grinding resistance value was reached.

6 Claims, 5 Drawing Sheets

GRINDING TOOL

RELATED APPLICATION

This is a continuation of application Ser. No. 08/427,037, filed on Aug. 16, 1994.

BACKGROUND OF THE INVENTION

1. Field of the Invention

The present invention is related to a grinding tool, specifically, it is related to a grinding tool suitable for processing hard materials by grinding in ductile mode.

2. Description of the Related Art

Conventional been grinding tools of various shapes are suitable for uses such as the cutting, surface grinding, or contour grinding in ductile mode of hard objects including glass, various ceramics, and silicon, etc. Such grinding tools generally use diamonds or other abrasive materials as the grinding particles, and the grinding tool is formed by bonding this abrasive material around the outside or on the tips of a rod shaped or disk shaped base member using sintering metal or adhesive. The grinding tool is installed on the rotating axis of a processing device, and, in a rotating state, grinding is achieved by directly contacting the surface of the object to be ground.

However, in conventional grinding tools, the grinding resistance in relation to the amount of grinding continues to increase, and becomes an extremely high value. Also, the cut made by the grinding tool worsens. For this reason, it is necessary to use high strength grinding machinery, and it further becomes necessary to frequently replace the grinding tool and perform so-called 'dressing'. Consequently, dressing must be performed many times when grinding large volumes. This frequent maintenance is inefficient and expensive.

SUMMARY OF THE INVENTION

A grinding tool is provided by the present invention which increases the operational efficiency when processing objects made of hard materials by grinding.

A grinding tool according to the present invention has a grinding surface which comes into direct contact with the surface of the object to be ground. The tool includes multiple small protuberances including diamonds or other abrasive materials on the grinding surface. Separation of the small protuberances is set to maintain a generally constant grinding resistance after a predetermined grinding resistance is reached.

Spaces are formed between the small protuberances, and promote the flow of water, oil or other cutting fluids which pass through these spaces. Thus, because the protuberances where the grinding particles are located have a small surface area, the cooling of the small protuberances and of the grinding particles is facilitated. Setting a particular ratio between space surface area and protuberance surface area in accordance with the present invention insures a steady abrasive action by the grinding particles, steady resistance and little deterioration and little abrasion of the small protuberances and the grinding particles. Steady removal of material also occurs, as a result of maintaining a constant grinding resistance.

DETAILED DESCRIPTION OF THE PREFERRED EMBODIMENT

Figure 1A:
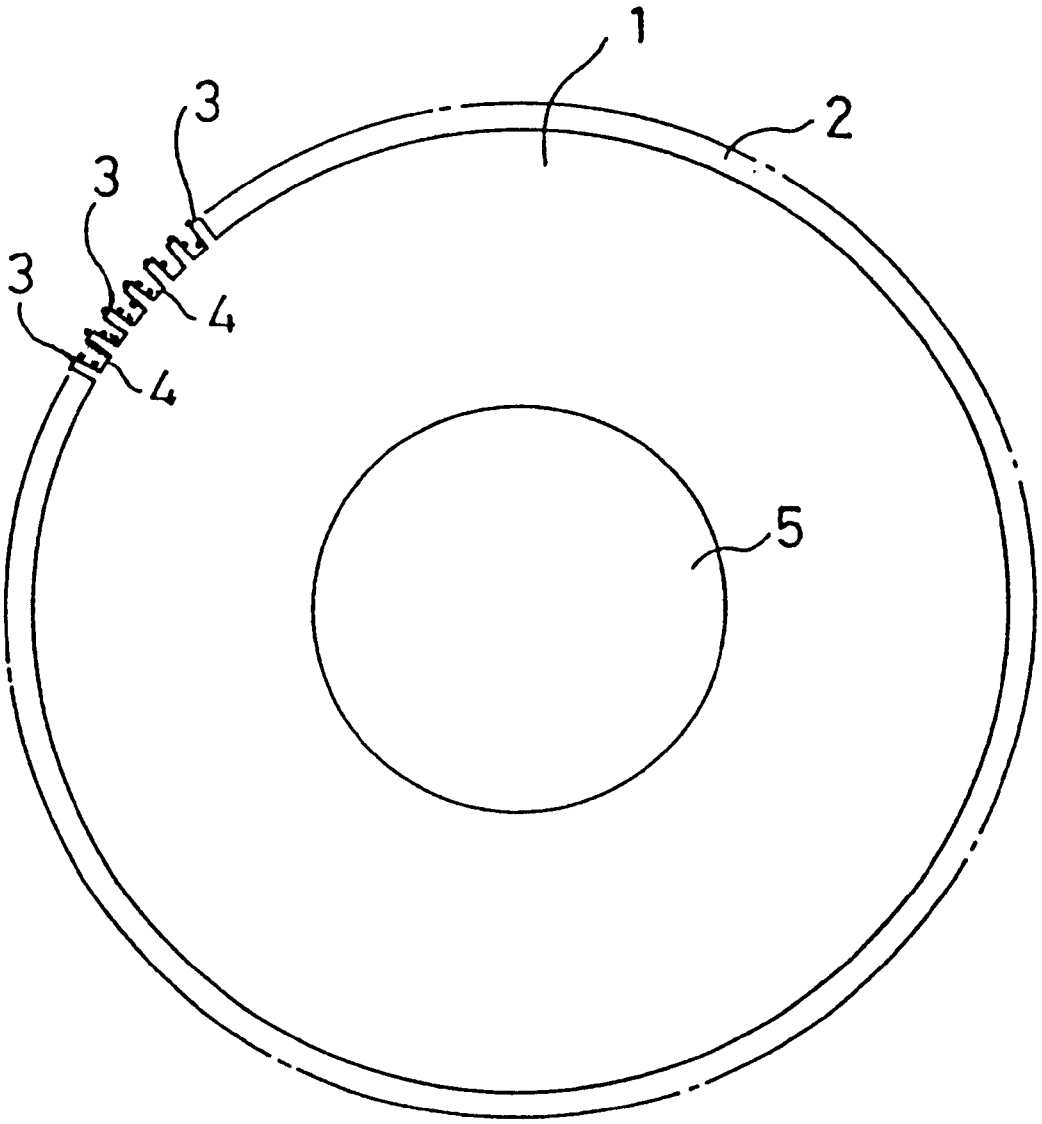
FIG. 1A is a planar view diagram of a disk cutter in accordance with the present invention and applied to a grinder for cutting ceramics or other similar object.
Figure 1B:
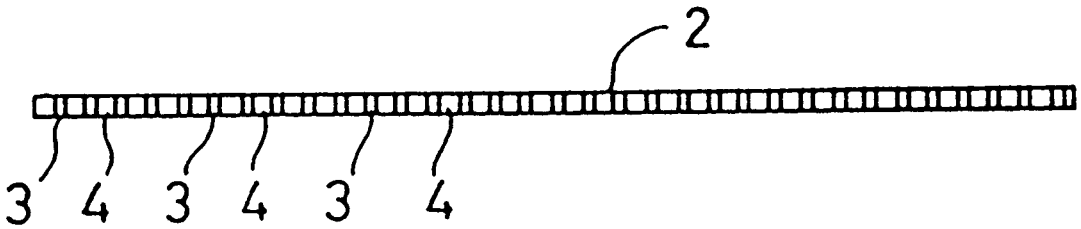
FIG. 1B is a side view diagram of the grinding tool.

Referring now to FIG. 1A, shown is a planar view diagram of a disk cutter indicating an example in which the present invention is applied to a disk cutter to cut, for example, ceramics; and FIG. 1B is a side view diagram of the above-mentioned disk cutter. Referring to both drawings, disk shaped base member 1 is formed of copper, bronze, brass, cast iron, stainless steel or other metallic material, and grinding surface 2 is formed on the peripheral edge part (the peripheral edge that opposes the disk surface) of this disk shaped base member 1. Multiple small protuberances 3, on which are included diamonds, rubies, or other abrasive materials, are formed on the grinding surface 2. The distance (space) 4 between adjacent small protuberances 3 is set so as to maintain the grinding resistance at an approximate constant value after a predetermined grinding resistance is reached, as described in more detail below. Circular hole 5 is cut in the central part of base member 1.

This circular hole 5 receives the rotatable axis of the processing device, which is not indicated in the diagram, and is attached by a securing member. In the example indicated in FIGS. 1A and 1B, the abrasive material included on small protuberances 3 uses #1000 mesh/square inch (hereinafter referred to as "mesh") diamonds, and a mixture of sintering metal and 50% diamond abrasive material is sintered and bonded in a single body to the above-mentioned base member 1. Also, the width in the rotational direction of above-mentioned small protuberances 3 is set to approximately 0.5 mm; the width in the rotational direction of above-mentioned spaces 4 between small protuberances 3 is set to approximately 2 mm; and the thickness is set to approximately 1 mm. In addition, the width in the rotational direction of above-mentioned small protuberances 3 and the width in the rotational direction of above-mentioned spaces 4 between small protuberances 3 have a relative relationship that achieves the aforementioned generally constant grinding resistance. Specifically, if the surface area that is the product of the width in the rotational direction of above-mentioned small protuberances 3 and the thickness of the disk cutter is made small, then the surface area that is the product of the width in rotational direction of above-mentioned spaces 4 and the thickness of the disk cutter will become small; and in the opposite situation, the surface area will become large. Furthermore, by varying the kind and particle size of abrasive material, it is necessary to set the surface area of above-mentioned small protuberances 3 and the surface area of above-mentioned spaces 4 so as to keep the grinding resistance at an approximate constant value after a predetermined grinding resistance is reached. In this example, the width in the rotational direction of above-mentioned small protuberances 3 and the width in the rotational direction of above-mentioned spaces 4 between the small protuberances 3 are generally fixed around the entire perimeter. However, the kind and particle size of the abrasive materials that are included on the small protuberances may be varied (for example, making groups in which the small protuberances are set up to include in order #80 mesh, #400 mesh, and #3000 mesh and other meshes of diamonds, and having several of these groups around the disk). In correspondence, the dimensions of the above-mentioned small protuberances 3 and the before-mentioned spaces 4 between them are made to vary. Specifically, the spaces between small protuberances including coarse grit abrasive material or the spaces between a small protuberance including coarse grit abrasive material and a small protuberance including fine grit abrasive material are set to be wider than the spaces between small protuberances including fine grit abrasive material. Alternatively, the spaces between the above-mentioned small protuberances may be fixed, and the surface area of the small protuberances on which coarse grit abrasive material are included is made smaller. Experimentation revealed that when the ratio of the surface area of the above-mentioned small protuberances 3 and the surface area of the before-mentioned spaces 4 was kept in the range from 1/5 through 1/1, the grinding resistance was maintained at an approximate constant value after a substantially constant grinding resistance value is reached. In addition, when actually grinding, the operation was conducted by pouring cooling fluid such as water or oil on the grinding surface of the object to be processed. In addition to the abrasive material, fluorine or acid can be mixed into the cooling fluid.

Figure 2:
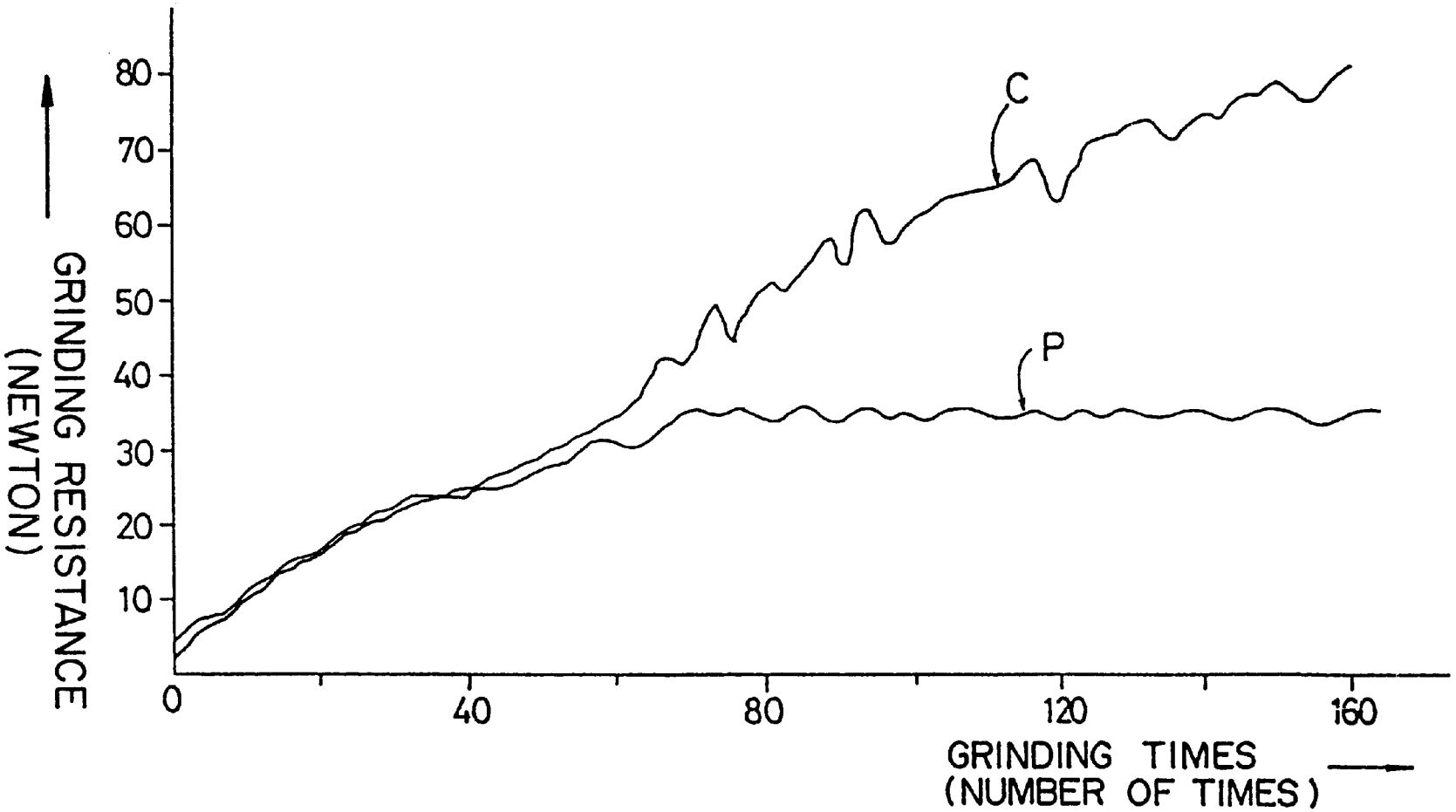
FIG. 2 is a characteristic grinding resistance curve diagram indicating the change of grinding resistance in relation to the increase in the amount of grinding.

FIG. 2 is a characteristic curve indicating the changes in grinding resistance in relation to the increase in the amount of grinding. Curve P is a characteristic curve of the grinding tool indicated in FIGS. 1A and FIG. 1B, and curve C is a characteristic curve of a conventional grinding tool. Further, in FIG. 2, the axis of abscissas indicates the number of times the specified part of the object to be ground is ground when assuming a numerical value, for example, a 1 micron cut, proportional to the amount of grinding of the object to be ground. The axis of ordinates shows the grinding resistance, and is expressed in units of Newtons. As indicated in this diagram, there is a marked tendency for the grinding resistance of conventional grinding tools to steadily increase along with the increase in the grinding times, and there are large fluctuations of this curve. In contrast to this, a grinding tool related to the present invention is not greatly different from the characteristic of conventional grinding tools in the initial stages of grinding, but, as indicated in the diagram, when the grinding resistance reaches about 35 newtons or more, the grinding resistance changes to a nearly fixed level, and there is a narrow width of fluctuations.

Figure 3A:
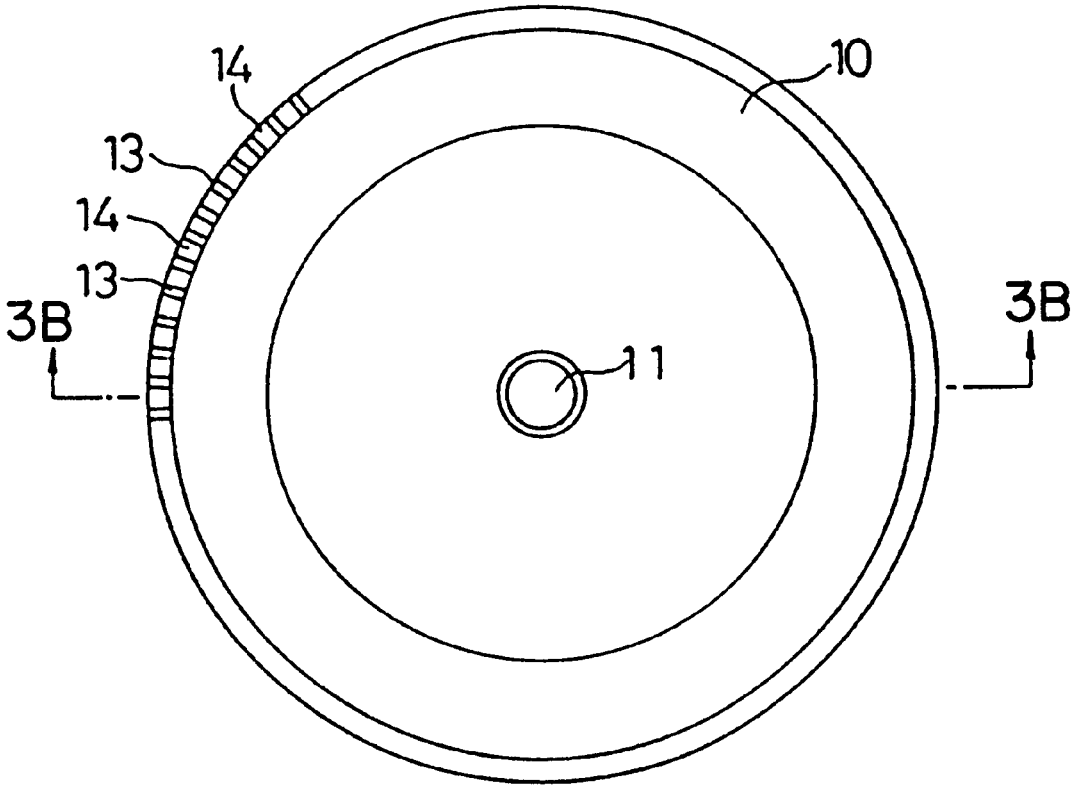
FIG. 3A is a planar view diagram illustrating an example of a grinding tool constructed in accordance with the present invention for grinding a flat surface.
Figure 3B:
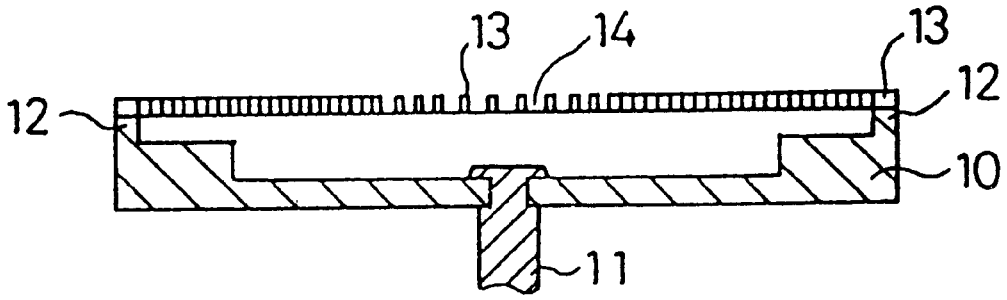
FIG. 3B is the IIIB—IIIB line cross sectional diagram of FIG. 3A.

FIG. 3A is a planar view diagram indicating one example of a grinding tool for the purpose of grinding a flat surface of the object to be processed, and FIG. 3B is an IIIB—IIIB line cross-sectional diagram of FIG. 3A.

Referring to both diagrams, disk shaped plate 10 is formed of the same materials as above-mentioned base member 1, and shaft 11 for the purpose of connecting the processing device is secured to the middle part. Also, jutting part 12 on the peripheral edge (peripheral edge parallel to the disk surface) of before-mentioned plate 10 is formed in the same direction as the lengthwise direction of above-mentioned shaft 11; small protuberances 13 and spaces 14, that are the same as those in the grinding tool indicated in above-mentioned FIGS. 1A and 1B, are formed on this stage part 12; and this part is taken to be the grinding surface. In addition, one part of small protuberances 13 are expressed in FIG. 3A, and the others are omitted. Moreover, technical matters relating to application of abrasive, spacing, and surface area ratios of the grinding tool indicated in above-mentioned FIGS. 1A, 1B can be generally applied to the grinding tool of this example. Thus, nearly the same characteristics as curve P in previously described FIG. 2 can be obtained. In addition, in this example, the width in the rotational direction of above-mentioned small protuberances 13 is set to approximately 1.5 mm; the width in the rotational direction of above-mentioned spaces 14 between small protuberances 13 is set to approximately 2 mm; and the width of the radial direction (direction distant from the center) is set to approximately 2 mm. Also, a #3000 mesh diamond abrasive material is used for inclusion on small protuberances 13.

Figure 4:
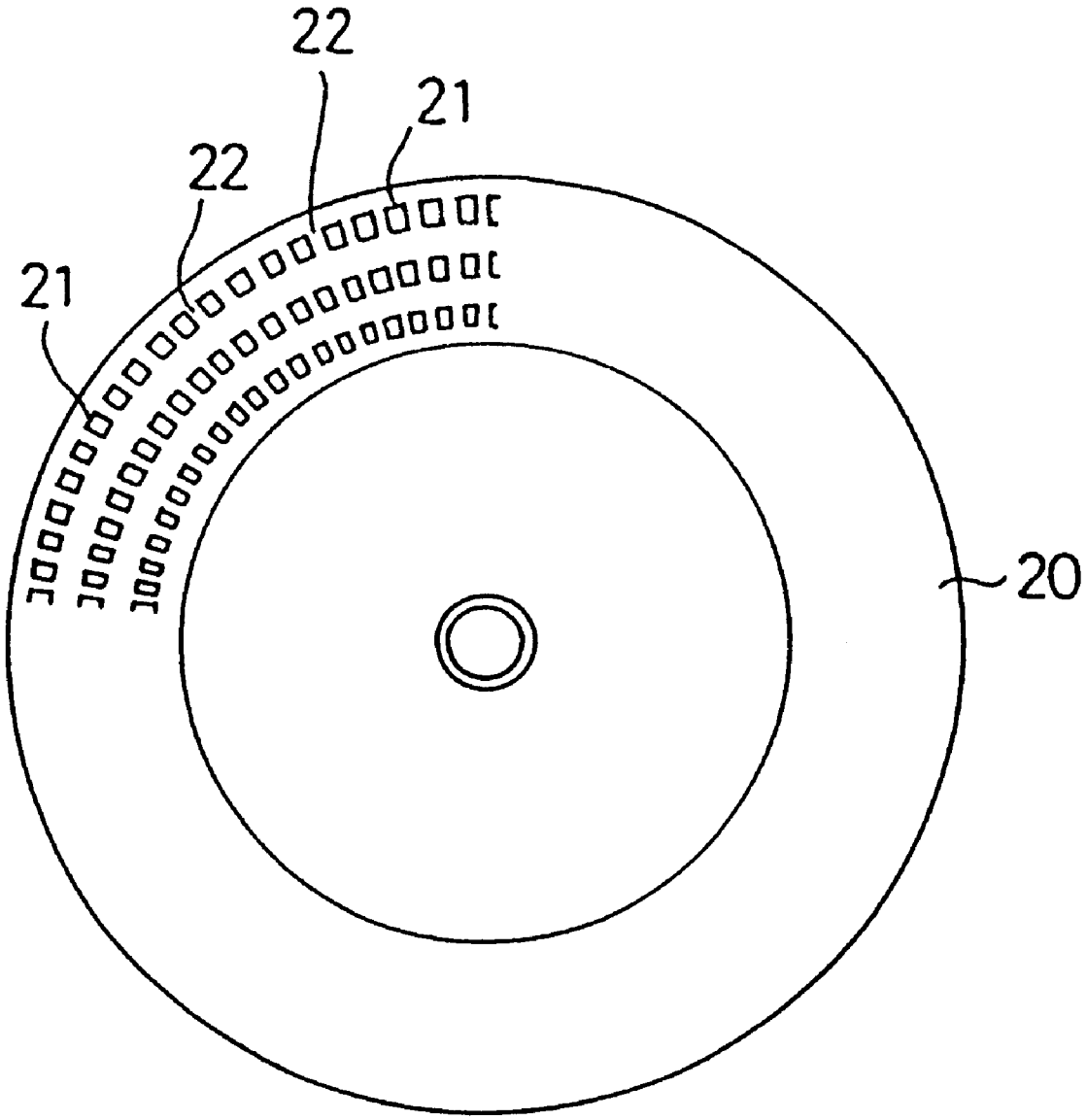
FIG. 4 is a planar view diagram indicating an example of a grinding tool constructed in accordance with the present invention for grinding a flat surface of the object to be ground in the same manner as the grinding tool indicated in FIG. 3A.

FIG. 4 is a planar view diagram indicating one example of a grinding tool for the purpose of grinding a flat surface of an object to be processed in the same way as the grinding tool indicated in FIG. 3A. In this diagram, a grinding surface is provided on the outer region of disk shaped plate 20. Small protuberances 21 and spaces 22 are formed on this grinding surface in the same way as in the grinding tool indicated in above-mentioned FIGS. 1A, 1B. Thus, in this example, three grinding rings formed from above-mentioned protuberances 21 and above-mentioned spaces 22 are arranged in concentric circles. In addition, the spacing, application of abrasive, and surface area ratios of the grinding tool indicated in above-mentioned FIGS. 1A and 1B can be applied to this example as well. The parts by which above-mentioned small protuberances 21 come into direct contact with the surface to be ground are nearly square shaped, but they may also be made into circular, triangular, pentagonal, hexagonal or other shapes, or combinations of these, or combinations of shapes with varying sizes (for example, combining small circular shapes with large circular shapes).

Figure 5A:
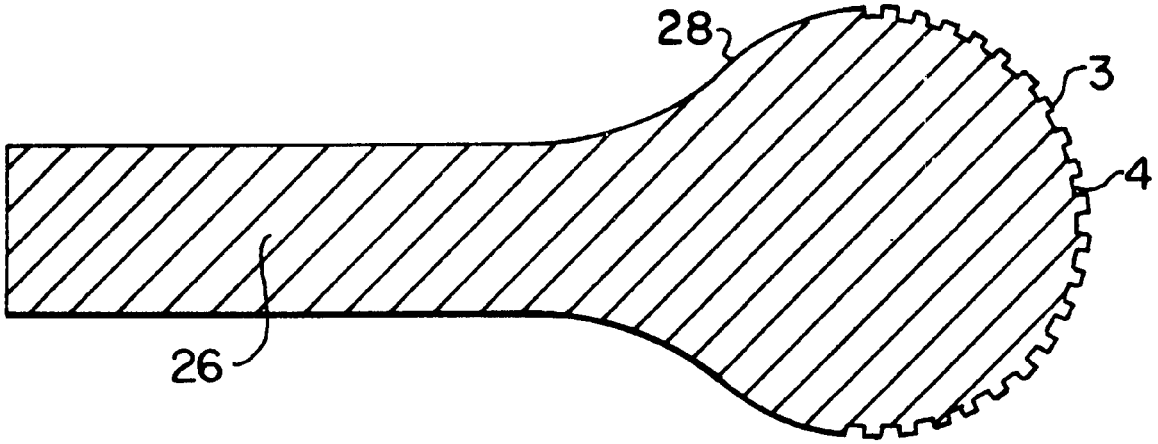
FIG. 5A shows a cross section view of a grinding tool constructed in accordance with the present invention in which protuberances are disposed on the end of a bulging rod.
Figure 5B:
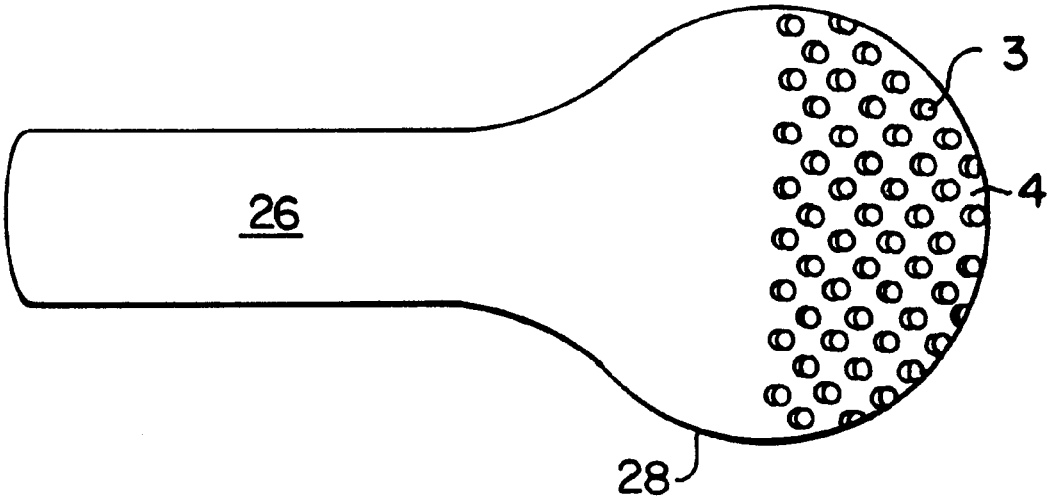
FIG. 5B shows a perspective view of the embodiment of FIG. 5A.

When the object to be processed includes a concave or other rounded surface, a grinding tool 26, as shown in FIGS 5A and 5B, like a pestle or small grinding stick is used, and the present invention can also be applied to this kind of grinding tool. Specifically, the multiple small protuberances 3 that were explained in the above-mentioned examples are formed on a bulging surface 28 which is formed near the edge of the grinding tool 26, and the spaces 4 between them in the rotational direction are set such that the grinding resistance is maintained at an approximate constant value after a predetermined grinding resistance value is reached.

As explained in detail above, according to the present invention, a grinding tool that can maintain a nearly constant cut over a long period of time can be obtained. Consequently, a stable ground surface can be obtained in relation to processing by grinding a hard object in ductile mode, and the operational efficiency can be markedly improved.

What is claimed is:

1. A grinding tool comprising:

a grinding surface that includes at least a portion thereof that contacts a surface of the object to be ground;

multiple small protuberances formed on the grinding surface and including abrasive materials thereon;

fixed width spaces between adjacent ones of said small protuberances, wherein a number of said protuberances have coarse abrasive materials thereon and remaining protuberances have fine abrasive materials thereon, and individual surface areas of said protuberances having coarse abrasive materials thereon are smaller than individual surface areas of said protuberances having fine abrasive materials thereon.

2. A grinding tool according to claim 1 in which the grinding surface comprises a peripheral edge of a disk.

3. A grinding tool according to claim 1 in which the grinding surface comprises a perimeter area of a circular flat disk.

4. A grinding tool according to claim 1 in which the grinding surface comprises a circular pattern on an outer peripheral surface of a flat circular disk.

5. A grinding tool according to claim 1 which the grinding surface comprises a bulging part formed on an edge of a rod.

6. A grinding tool comprising:

a grinding surface that includes at least a portion thereof that directly contacts a surface of the object to be ground;

multiple small protuberances formed on the grinding surface and including abrasive materials thereon, some of said protuberances having coarse abrasive materials thereon and others having fine abrasive materials thereon; and spaces between the small protuberances which vary in width so that spaces between any two adjacent protuberances which both have fine abrasive materials thereon are smaller than either spaces between any two adjacent protuberances which both have coarse abrasive materials thereon, or spaces between any two adjacent protuberances which have different abrasive materials thereon.

* * * * *

UNITED STATES PATENT AND TRADEMARK OFFICE

CERTIFICATE OF CORRECTION

PATENT NO. : 6,142,860
DATED : November 7, 2000
INVENTOR(S) : Hashimoto

It is certified that error appears in the above-identified patent and that said Letters Patent is hereby corrected as shown below:

Title page,
Item [56], References Cited, FOREIGN PATENT DOCUMENTS, please insert the following foreign references:

| | | |
|---|---|---|
| -- 4867890 | 9/1973 | Japan |
| 52129091 | 1977 | Japan |
| 54129888 | 1979 | Japan |
| 6165778 | 4/1986 | Japan -- |

Item [56] References Cited, for United Kingdom reference 2117289A, please delete "3/1982" and insert -- 10/1983 -- therefor.

Signed and Sealed this

Second Day of April, 2002

*Attest:*

*Attesting Officer*

JAMES E. ROGAN
*Director of the United States Patent and Trademark Office*